US009098047B2

(12) United States Patent
Miwa et al.

(10) Patent No.: US 9,098,047 B2
(45) Date of Patent: Aug. 4, 2015

(54) IMAGE FORMING APPARATUS WITH A SUPPORTING STRUCTURE TO SUPPORT MOVABLE PARTS

(71) Applicants: Atsushi Miwa, Anjo (JP); Tomoya Yamamoto, Nagoya (JP)

(72) Inventors: Atsushi Miwa, Anjo (JP); Tomoya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 73 days.

(21) Appl. No.: 14/036,738

(22) Filed: Sep. 25, 2013

(65) Prior Publication Data

US 2014/0093282 A1 Apr. 3, 2014

(30) Foreign Application Priority Data

Sep. 28, 2012 (JP) ..... 2012-216229

(51) Int. Cl.
*G03G 15/00* (2006.01)
*G03G 21/18* (2006.01)

(52) U.S. Cl.
CPC ..... *G03G 15/757* (2013.01); *G03G 21/1857* (2013.01)

(58) Field of Classification Search
CPC ..... G03G 15/757; G03G 21/1857
USPC ..... 399/90, 167, 110, 111
See application file for complete search history.

(56) References Cited

U.S. PATENT DOCUMENTS

2013/0259528 A1* 10/2013 Yamamoto ..... 399/167

FOREIGN PATENT DOCUMENTS

| | | | |
|---|---|---|---|
| JP | 3035142 | B2 | 4/2000 |
| JP | 2000-131906 | A | 5/2000 |
| JP | 2002-040738 | A | 2/2002 |
| JP | 2008-015077 | A | 1/2008 |

OTHER PUBLICATIONS

Translation of jp2008-015077a, publ. on Jan. 24, 2008.*

* cited by examiner

*Primary Examiner* — Quana M Grainger
(74) *Attorney, Agent, or Firm* — Banner & Witcoff, Ltd.

(57) ABSTRACT

An image forming apparatus, including an image forming unit; a resin-made frame to support the image forming unit; a drive source arranged on a one-end side of a transmission path to generate driving force; a gear arranged on the other-end side of the transmission path to be rotated, while one of axial ends of a shaft of the gear is supported by the frame; a metal-made first supporting member fixed to the frame to support the other of axial ends of the shaft of the gear thereon; a metal-made second supporting member fixed to the frame to support the drive source thereon and; an endless belt; a first pulley supported by the second supporting member to transmit the driving force to the endless belt, the first pulley being; and a second pulley having the endless belt strained therearound and supported by the first supporting member, is provided.

13 Claims, 16 Drawing Sheets

AREA A ENLARGED

IMAGE FORMING APPARATUS WITH A SUPPORTING STRUCTURE TO SUPPORT MOVABLE PARTS

CROSS REFERENCE TO RELATED APPLICATION

This application claims priority from Japanese Patent Application No. 2012-216229, filed on Sep. 28, 2012, the entire subject matter of which is incorporated herein by reference.

BACKGROUND

1. Technical Field

An aspect of the present invention relates to an image forming apparatus for forming an image on a sheet.

2. Related Art

An image forming apparatus having lateral plates, on which gears to be driven to operate various kinds of rollers are attached, is known. The gears may be driven by driving force, which is generated in an electric motor and transmitted to the gears via a toothed belt.

In general, a frame assembly in such an image forming apparatus, including the lateral plates, may be required to be substantially rigid. Therefore, the frame assembly is often equipped with metal-made frames. On the contrary, in consideration of manufacturing cost reduction, resin-made frames may be preferable.

SUMMARY

While the resin frames tend to be less rigid compared to the metal frames, however, it may be difficult to maintain drivable parts, to which the driving force is applied, such as gears, in accurate relative positions on the less rigid resin frames.

The present invention is advantageous in that an image forming apparatus, which includes resin-made frames, and in which the drivable parts can be maintained in accurate positions, is provided.

According to an aspect of the present invention, an image forming apparatus is provided. The image forming apparatus includes an image forming unit configured to form an image on a sheet; a frame made of resin and configured to support the image forming unit; a drive source configured to generate driving force, the drive source being on a one-end side of a transmission path for the driving force; a gear arranged on the other-end side of the transmission path and configured to be rotated by the driving force generated in the drive source, one of axial ends of a shaft of the gear being supported by the frame; a first supporting member made of metal, fixed to the frame, and configured to support the other of axial ends of the shaft of the gear thereon; a second supporting member made of metal, fixed to the frame, and configured to support the drive source thereon; an endless belt configured to transmit the driving force from the one-end side to the other-end side; a first pulley configured to transmit the driving force generated in the drive source to the endless belt, the first pulley being supported by the second supporting member; and a second pulley arranged to have the endless belt strained therearound and configured to transmit the driving force transmitted from the first pulley via the endless belt toward the other-end side, the second pulley being supported by the first supporting member.

BRIEF DESCRIPTION OF THE ACCOMPANYING DRAWINGS

Figure 3:
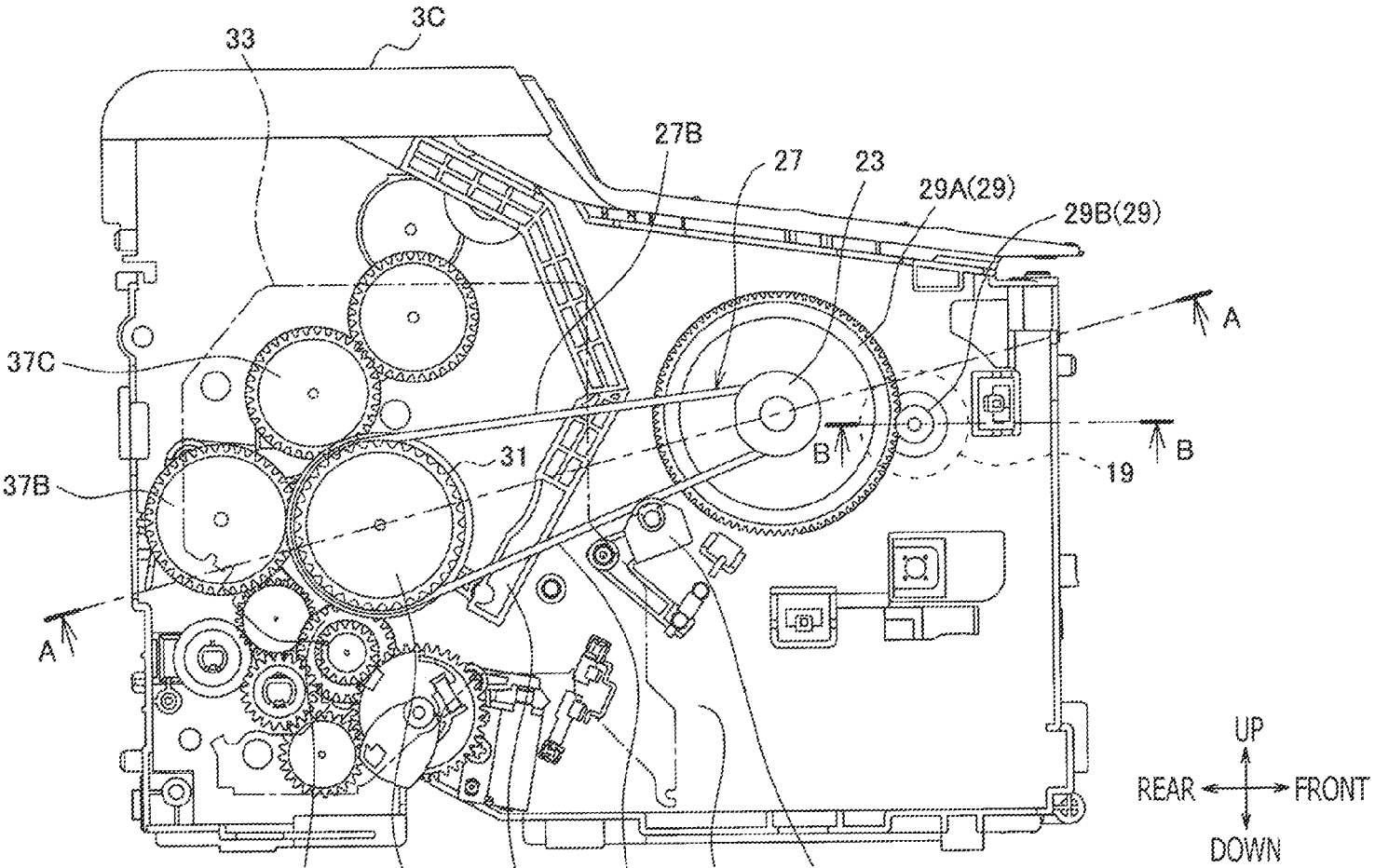

FIG. 3 is an illustrative side view of a frame 17 on a left-hand side with a driving pulley 23 and a driven pulley 25 in the image forming apparatus 1 according to the embodiment of the present invention.

Figure 4:
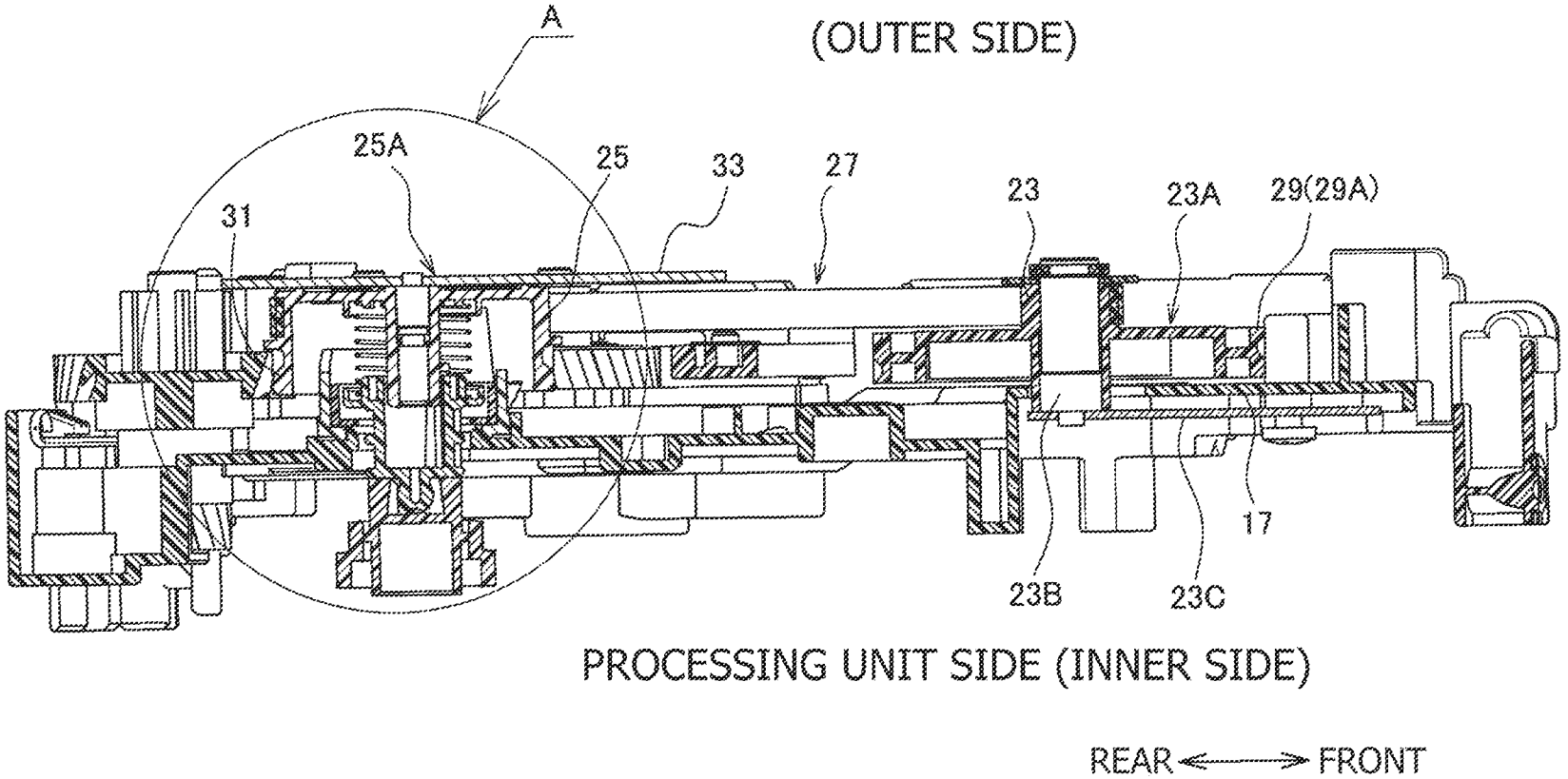

FIG. 4 is a cross-sectional view of the frame 17 with the driving pulley 23 and the driven pulley 25 in the image forming apparatus 1 according to the embodiment of the present invention taken along a line A-A shown in FIG. 3.

Figure 5:
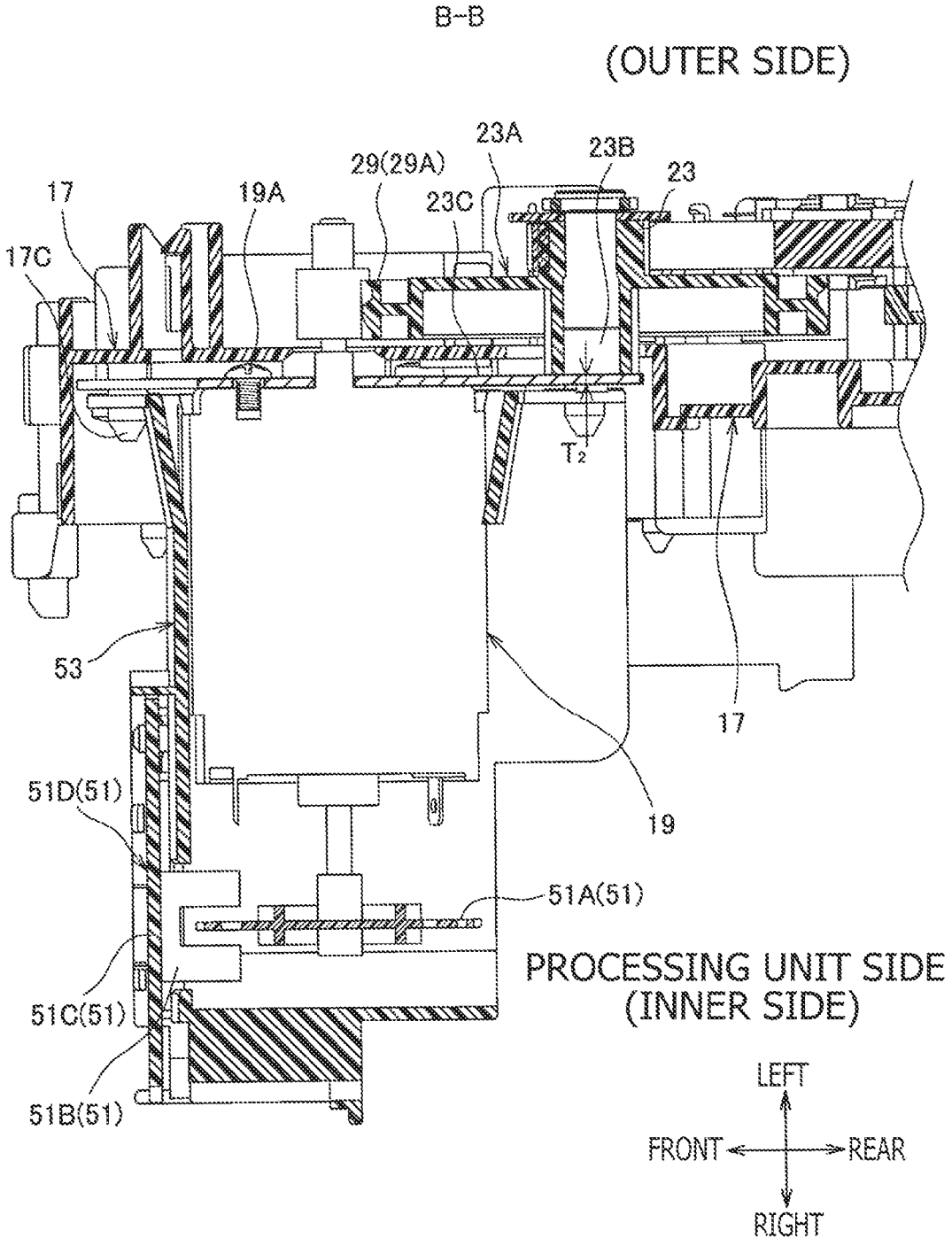

FIG. 5 is a cross-sectional partial view of the frame 17 in the image forming apparatus 1 according to the embodiment of the present invention taken along a line B-B shown in FIG. 3.

Figure 6:
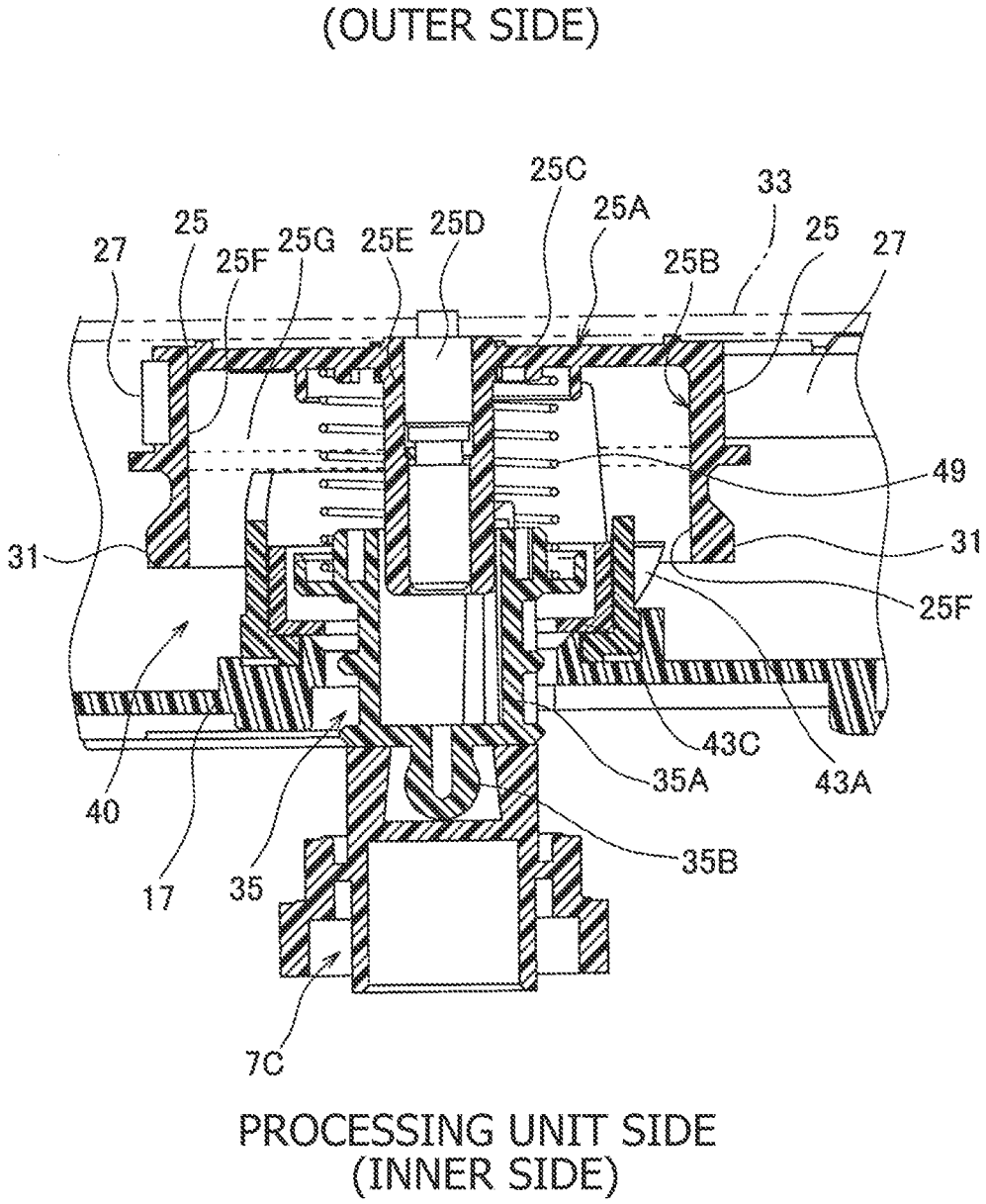

FIG. 6 is a partially enlarged view of the driven pulley 25 and surroundings in an engaged position in the image forming apparatus 1 according to the embodiment of the present invention.

Figure 7:
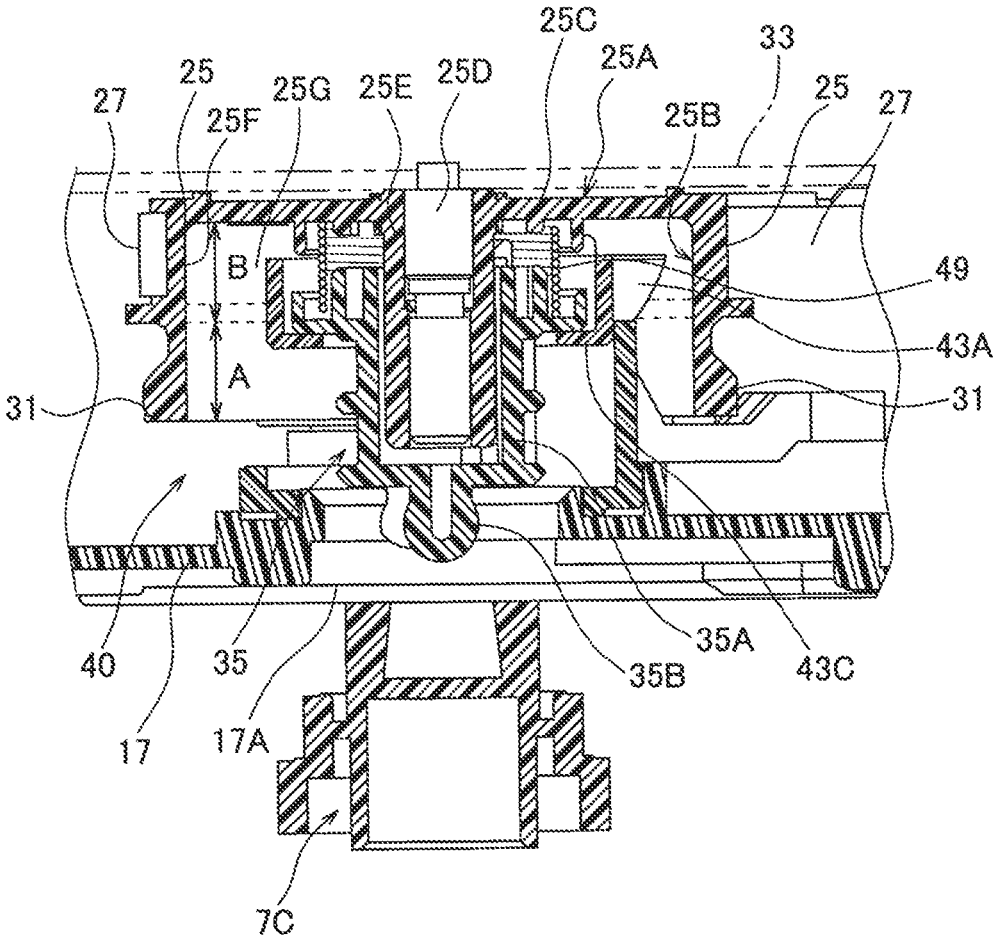

FIG. 7 is a partially enlarged view of the driven pulley 25 and surroundings in a disengaged position in the image forming apparatus 1 according to the embodiment of the present invention.

Figure 8:
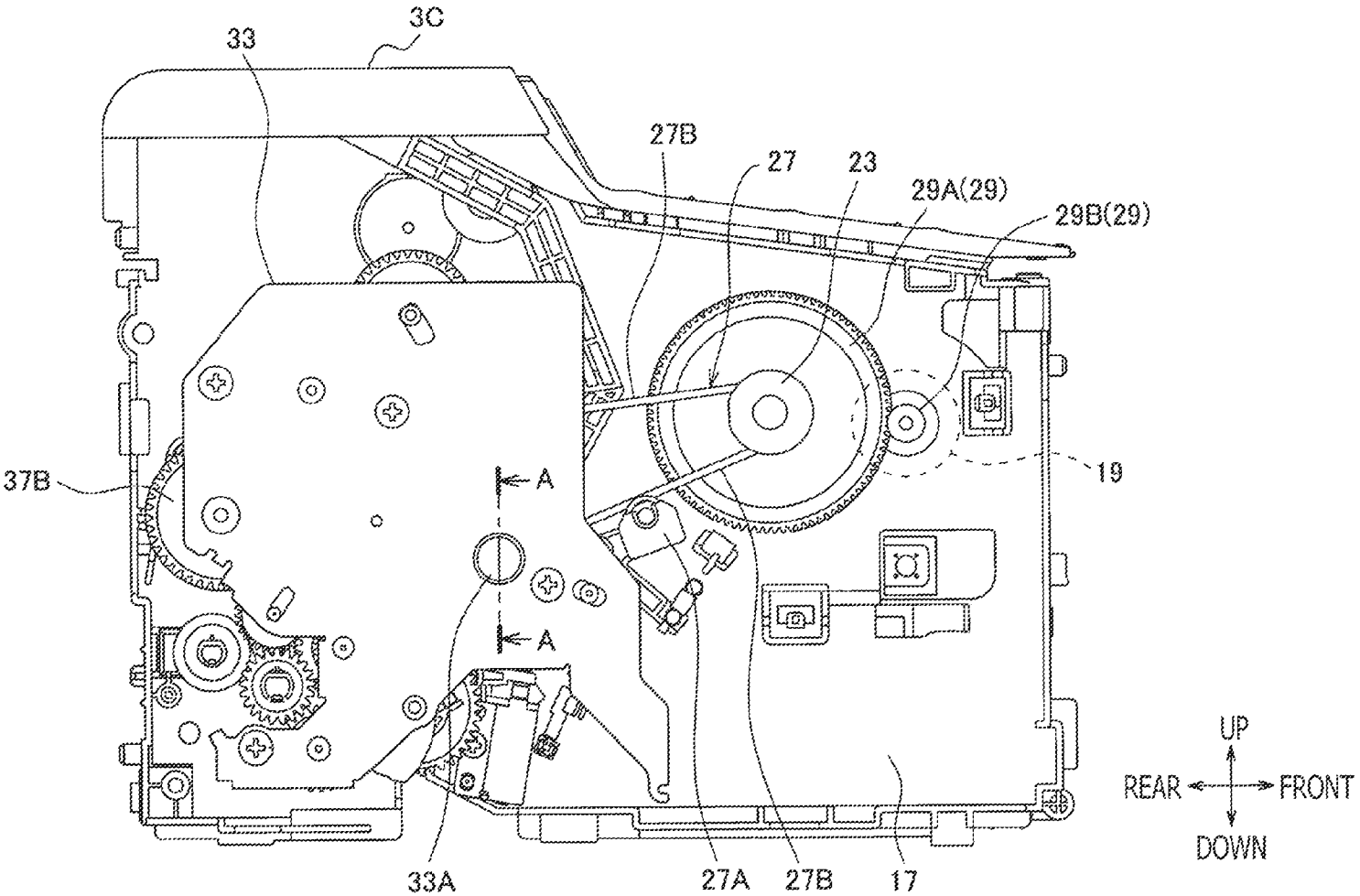

FIG. 8 is an illustrative side view of the frame 17 on the left-hand side with a first supporting member 33 in the image forming apparatus 1 according to the embodiment of the present invention.

Figure 9:
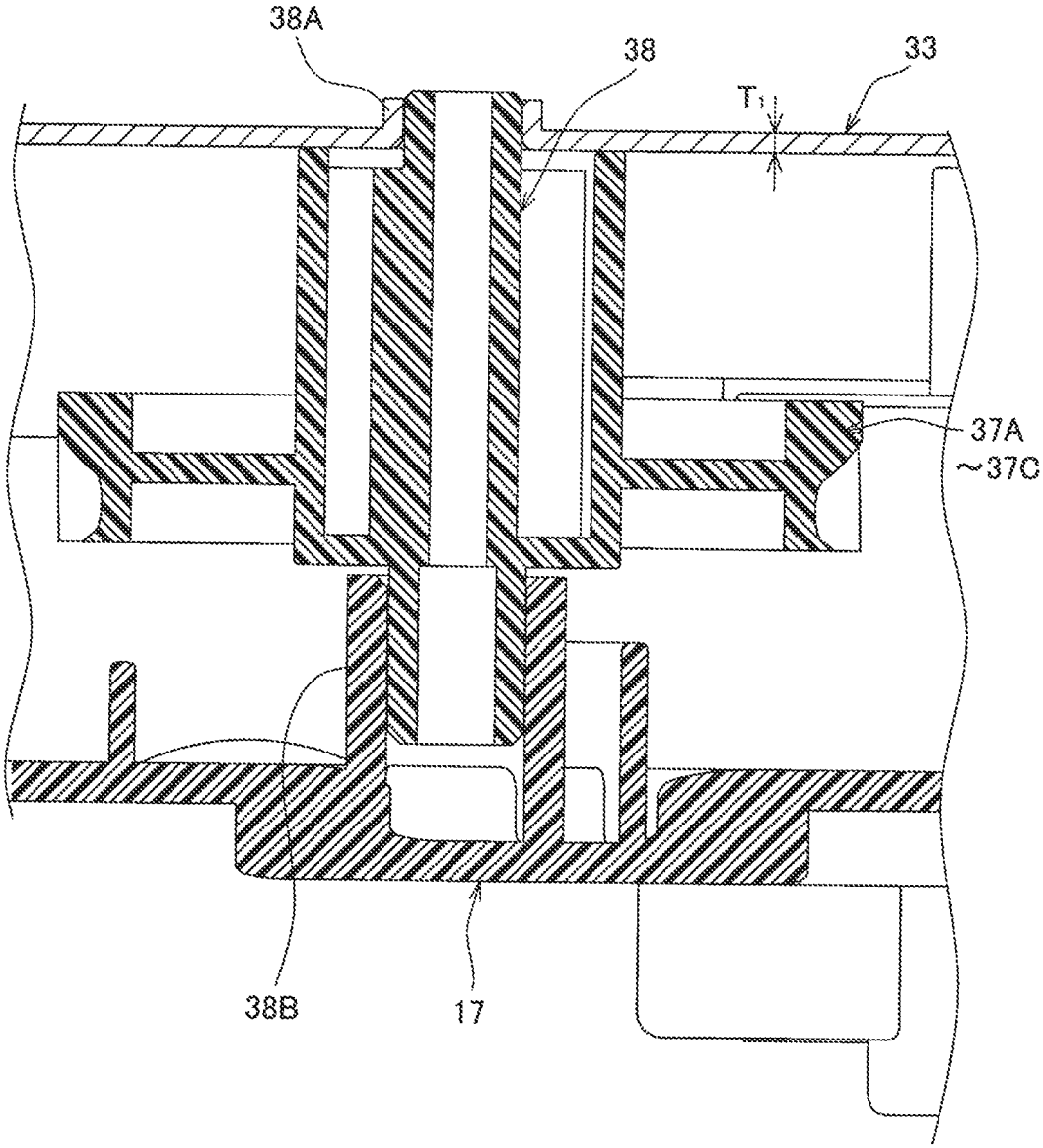

FIG. 9 is a cross-sectional view of the first supporting member 33 to support gears 37A-37C in the image forming apparatus 1 according to the embodiment of the present invention.

Figure 10:
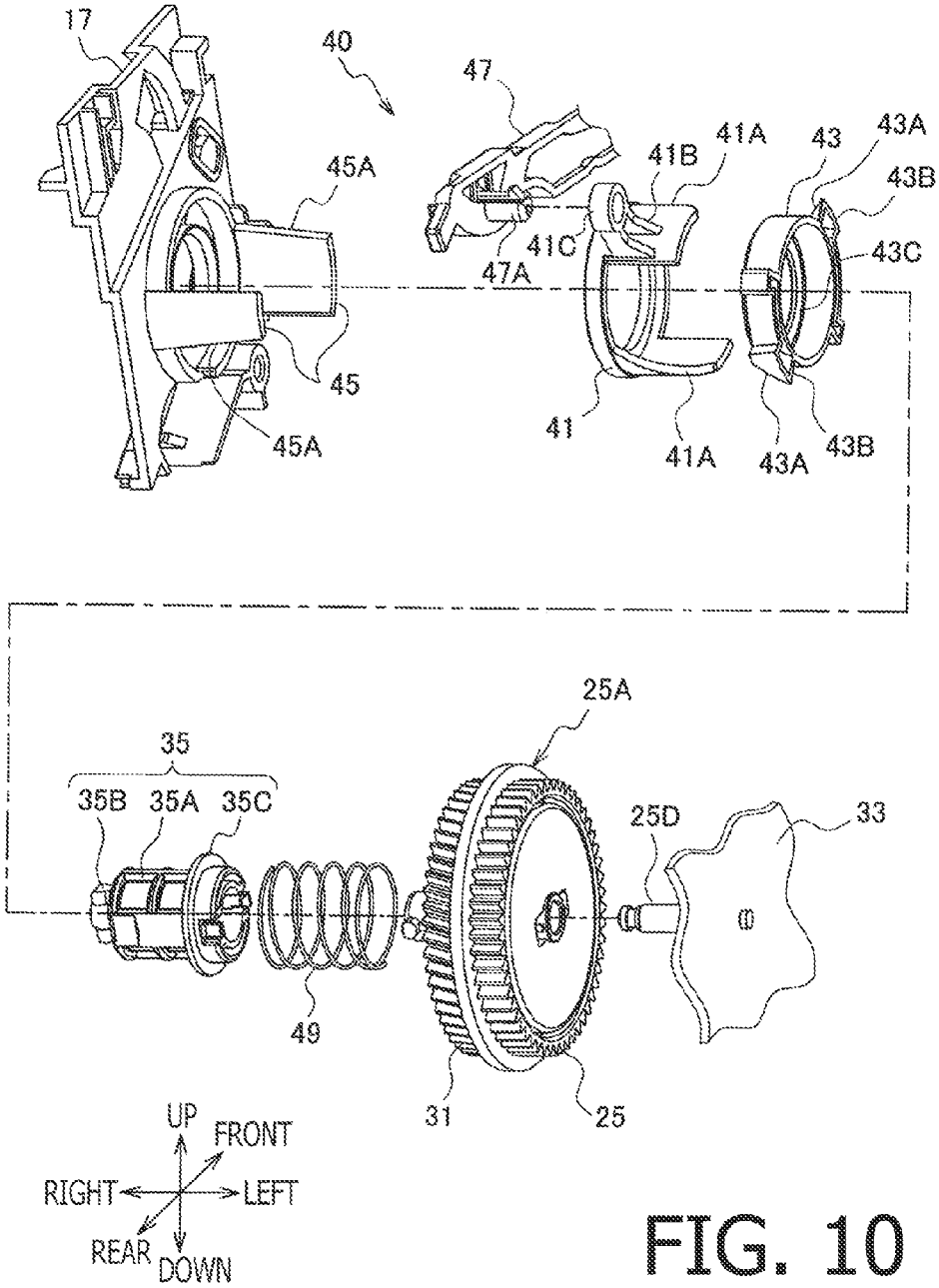

FIG. 10 is an exploded view of a joint driving system 40 in the image forming apparatus 1 according to the embodiment of the present invention.

Figure 11:
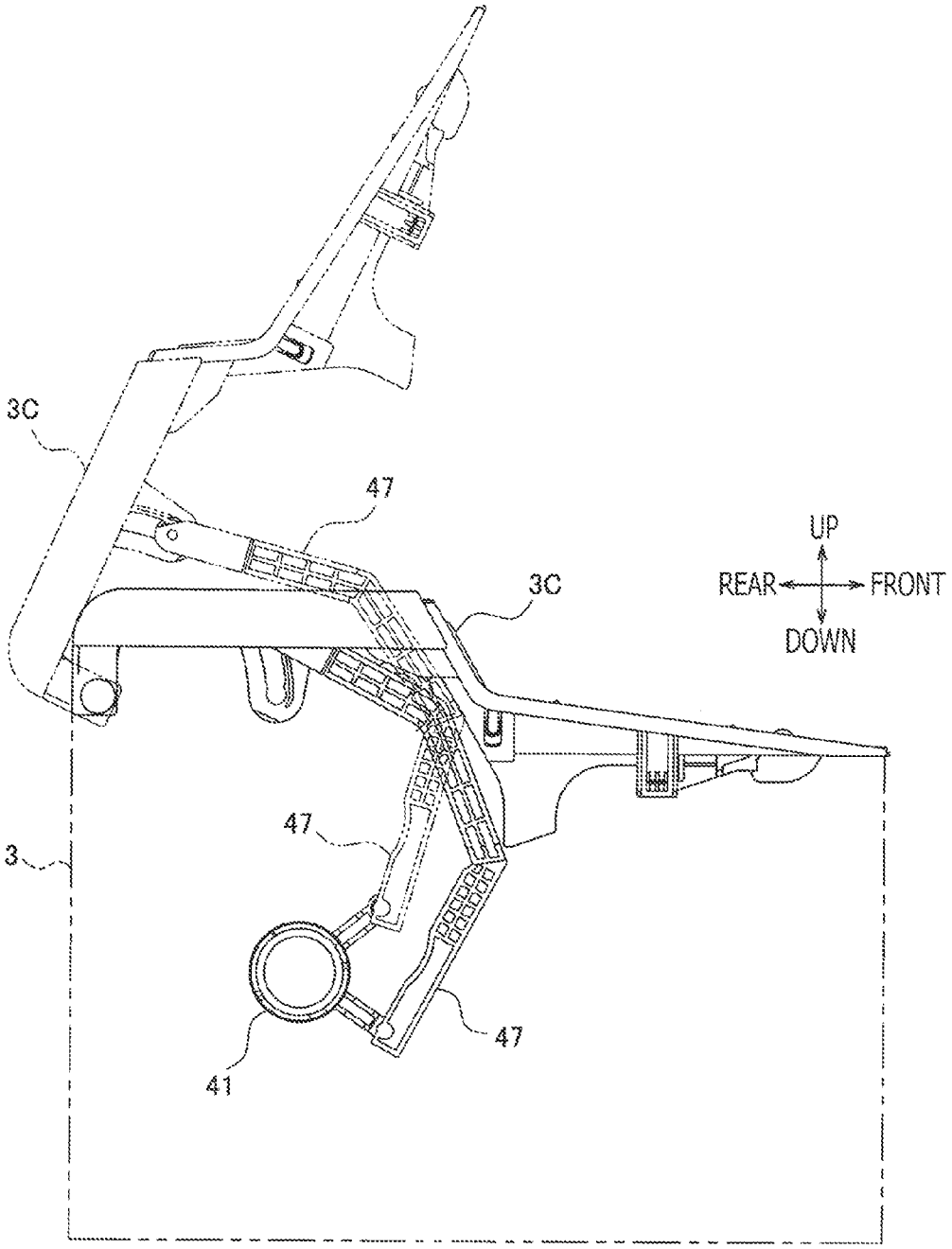

FIG. 11 is an illustrative side view of a top cover 3C being movable between an open position and a closed position in the image forming apparatus 1 according to the embodiment of the present invention.

Figure 12:
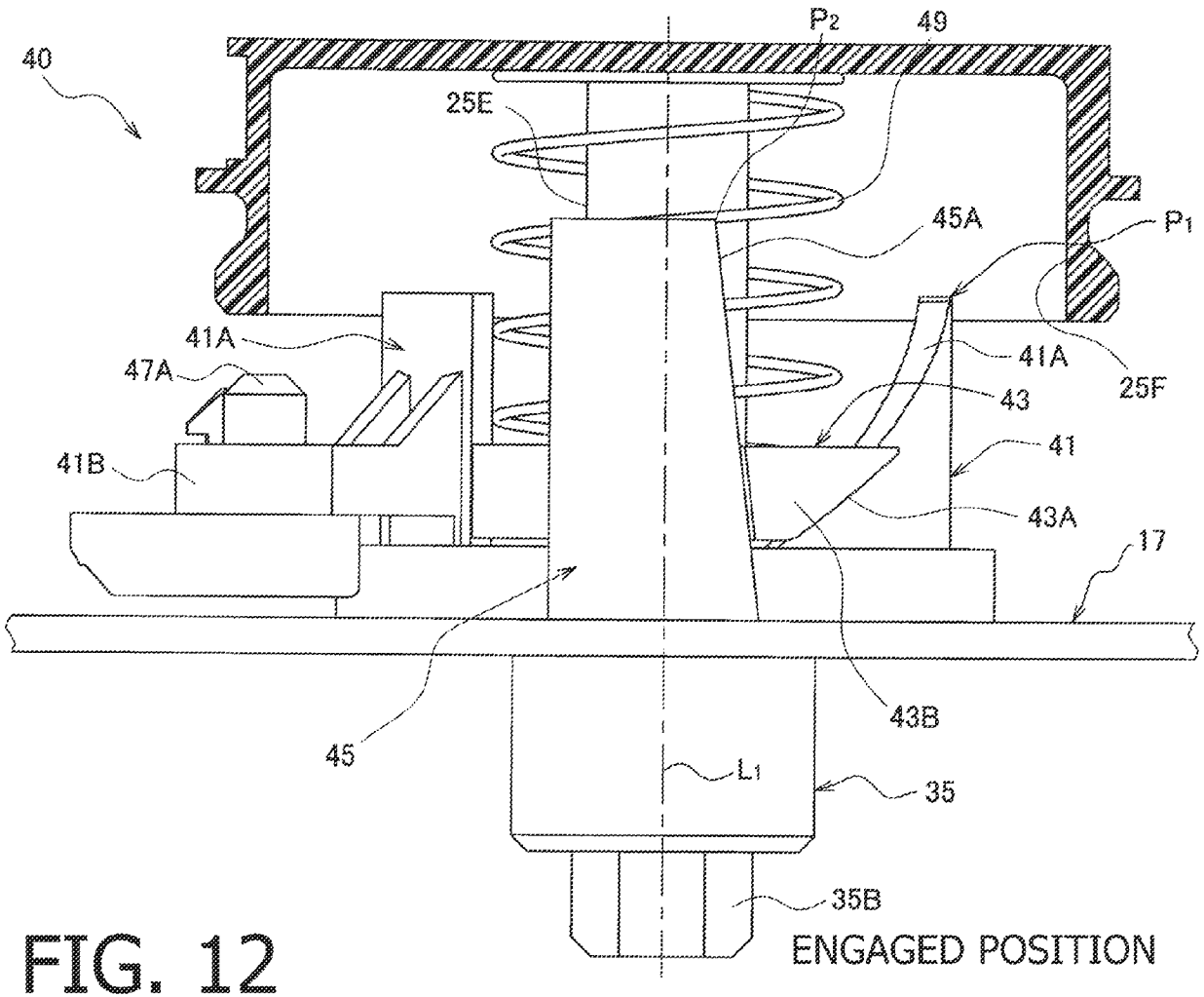

FIG. 12 illustrates a movement of the joint driving system 40 in the image forming apparatus 1 according to the embodiment of the present invention.

Figure 13:
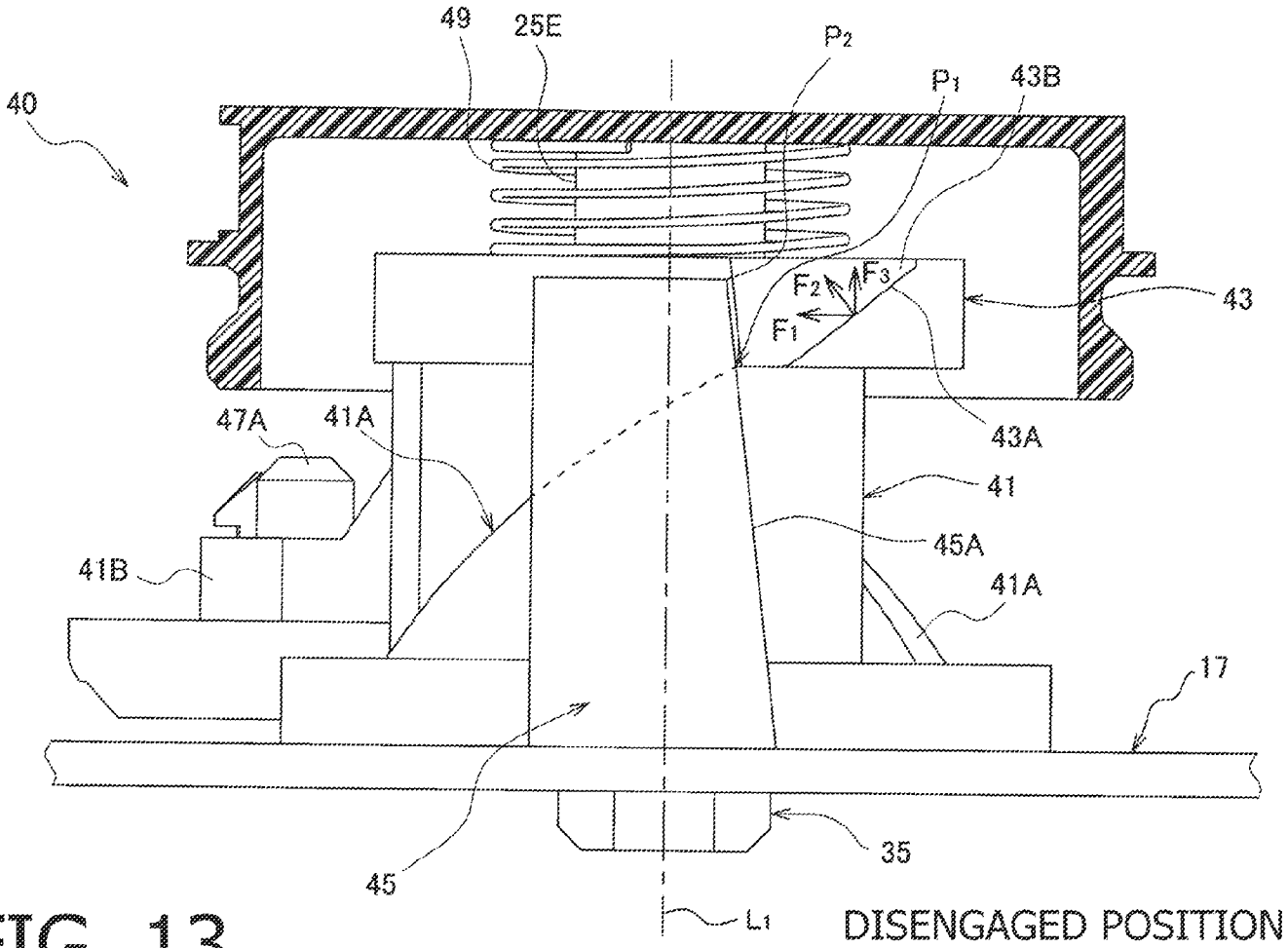

FIG. 13 illustrates a movement of the joint driving system 40 in the image forming apparatus 1 according to the embodiment of the present invention.

Figure 14B:
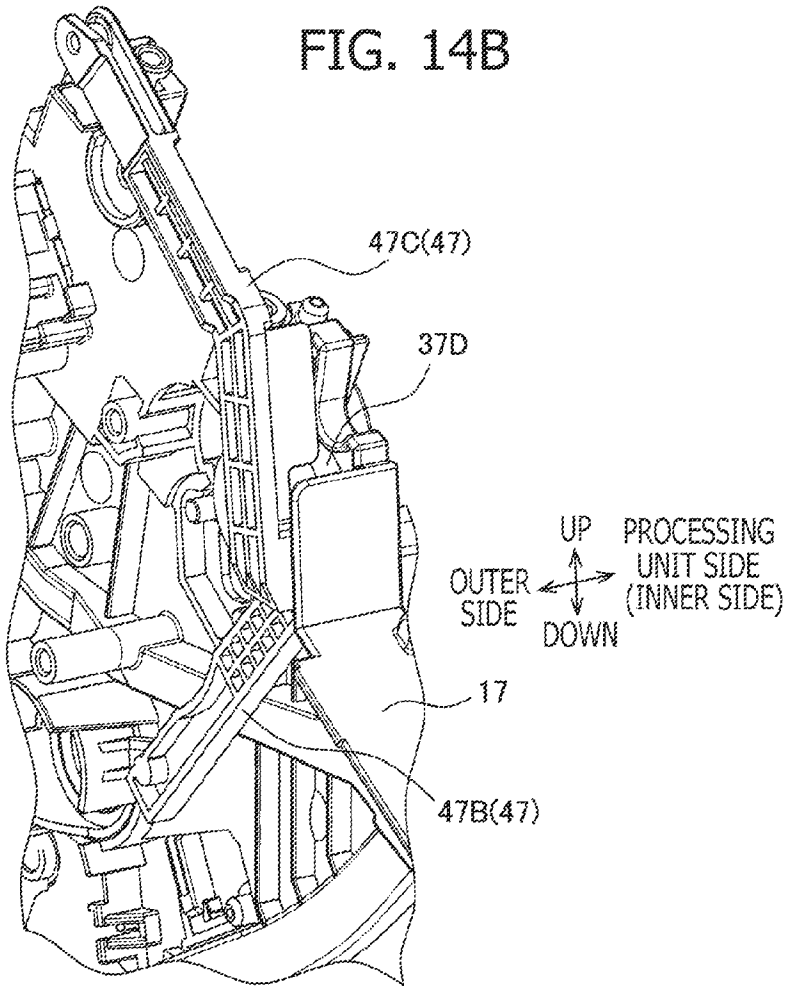
Figure 14A:
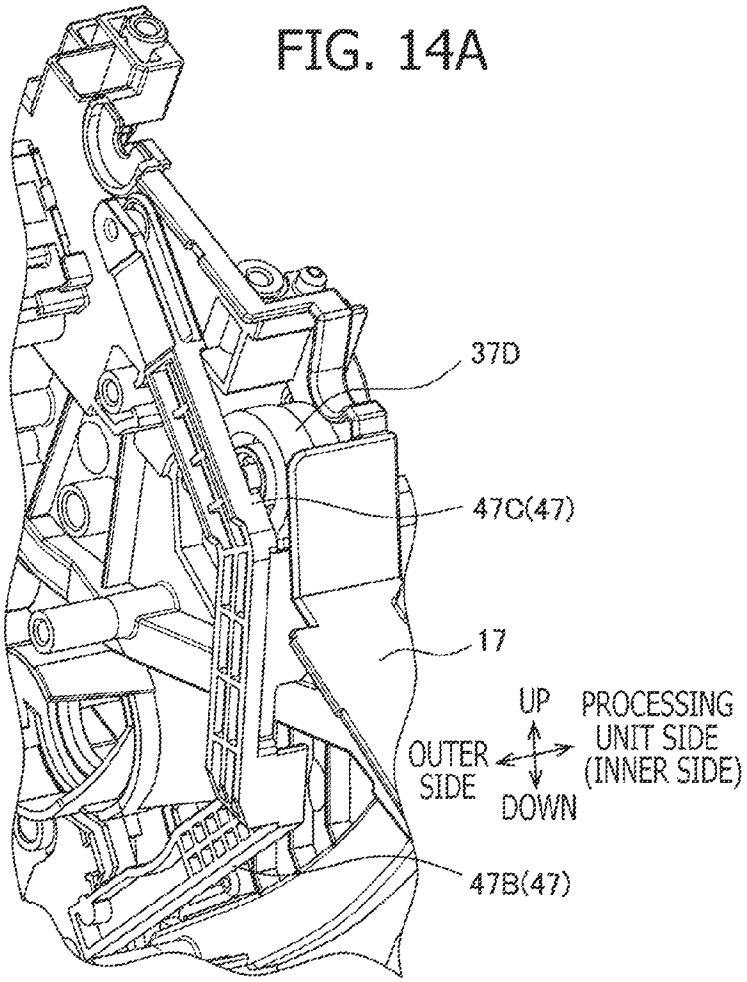

FIGS. 14A and 14B are partially enlarged perspective views of a linker 47 in the image forming apparatus 1 according to the embodiment of the present invention.

Figure 15B:
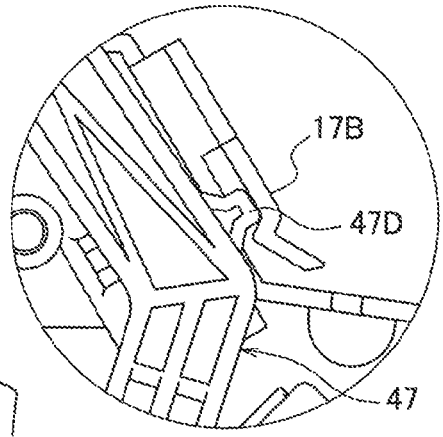
Figure 15A:
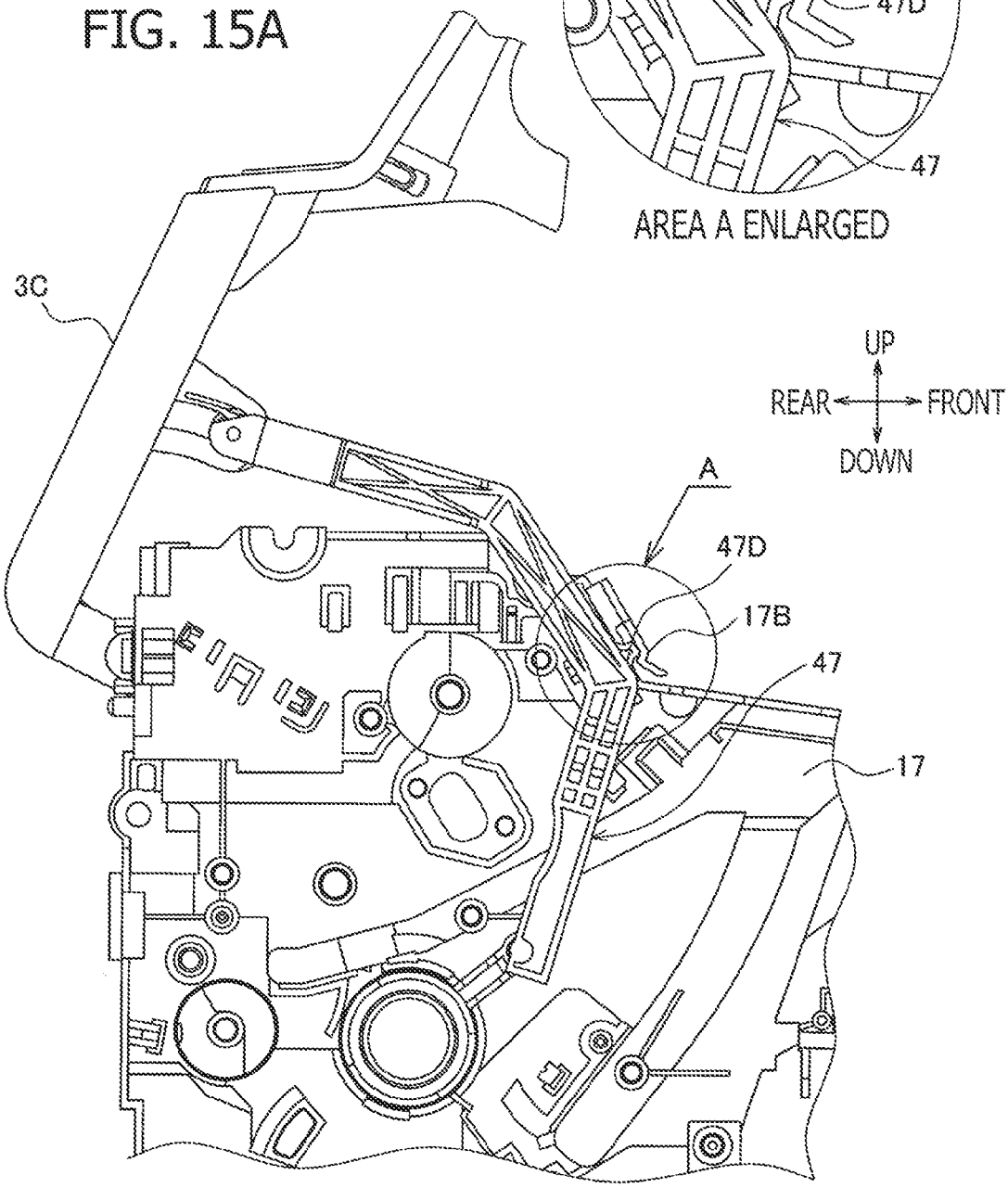

FIG. 15A illustrates the top cover 3A being in the open position in the image forming apparatus 1 according to the embodiment of the present invention. FIG. 15B is an enlarged view of an encircled area shown in FIG. 15A.

Figure 16:
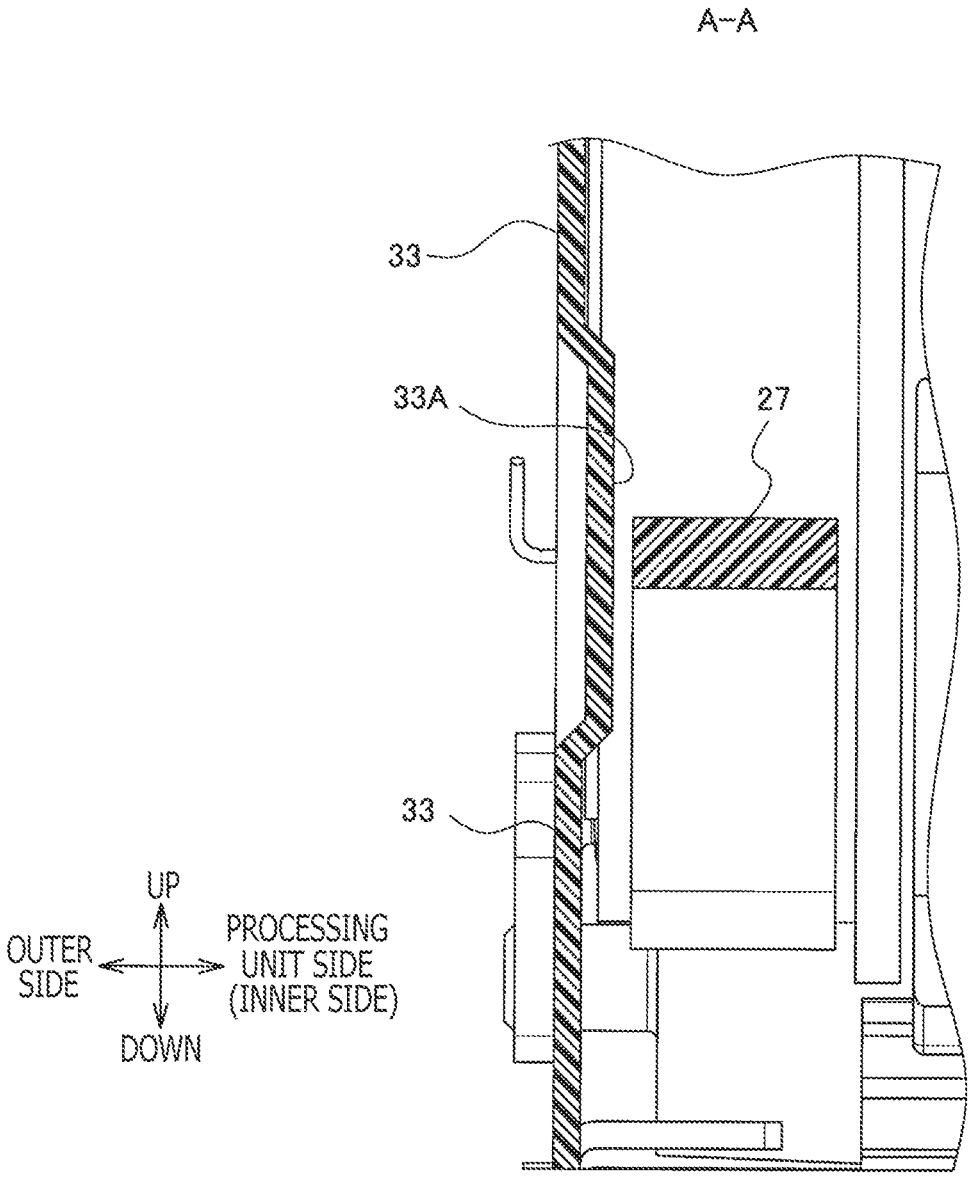

FIG. 16 is a cross-sectional view of the frame 17 in the image forming apparatus 1 according to the embodiment of the present invention taken along a line A-A shown in FIG. 8.

DETAILED DESCRIPTION

Hereinafter, an embodiment of the present invention will be described with reference to the accompanying drawings. It is noted that various connections are set forth between elements in the following description. These connections in general, and unless specified otherwise, may be direct or indirect, and this specification is not intended to be limiting in this respect.

1. Overall Configuration of Image Forming Apparatus

An overall configuration of an image forming apparatus 1 according to the embodiment will be described with reference to FIG. 1. In the following description, directions concerning the image forming apparatus 1 will be referred to in accordance with orientation indicated by arrows in the drawings. The image forming apparatus 1 being a monochrome image forming apparatus includes a chassis 3, which accommodates an image forming unit 5 inside. On a front face of the chassis 3, a swingable sheet-feeder cover 3A is attached. On top of the chassis 3, a swingable sheet-ejection cover 3B is attached.

Figure 1:
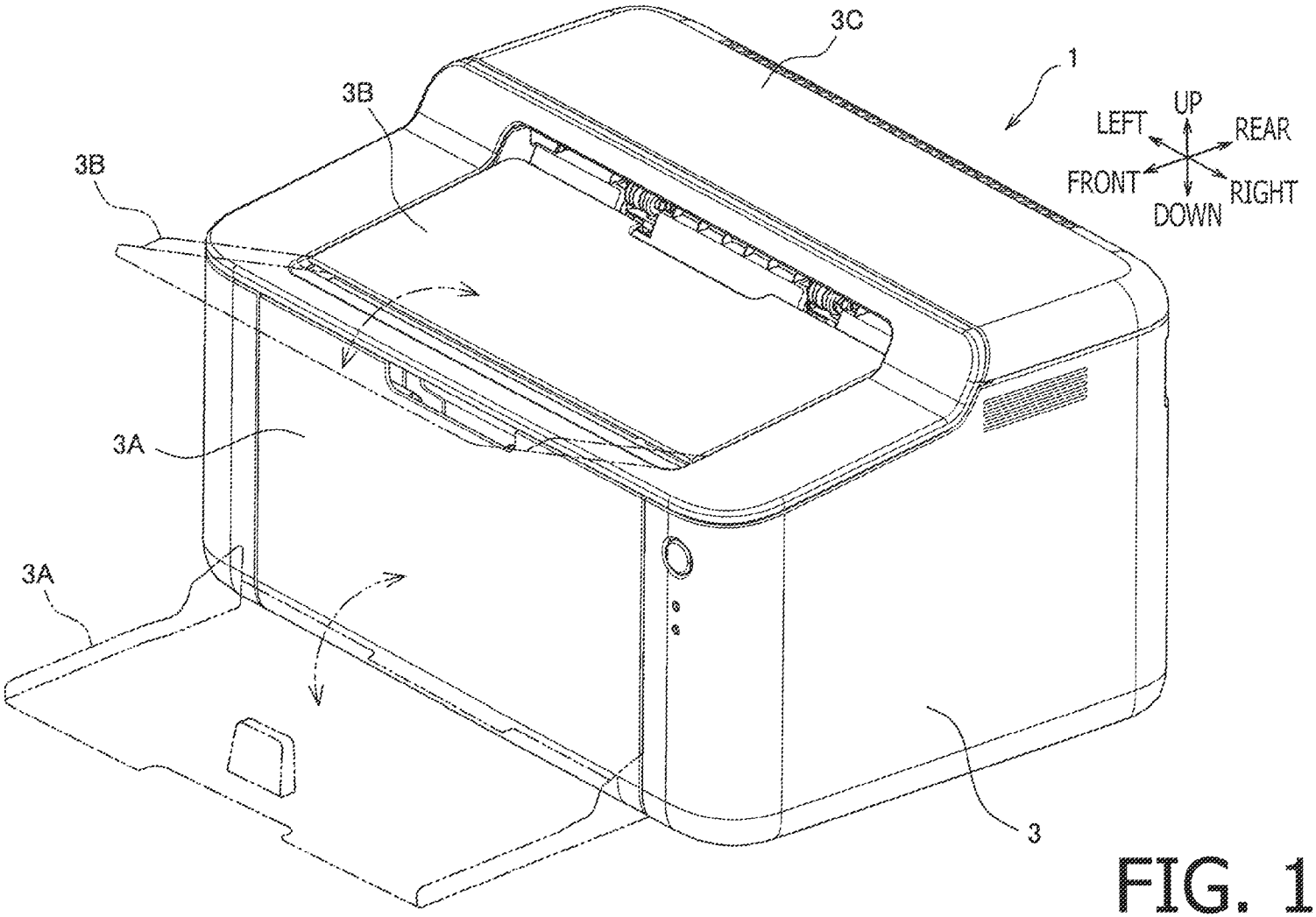
FIG. 1 is an external perspective view of an image forming apparatus 1 according to an embodiment of the present invention.

When an image is formed on a sheet, the sheet-feeder cover 3A and the sheet-ejection cover 3B are pivoted frontward to positions indicated in double-dotted chain lines in FIG. 1 to be opened so that the sheet is set on the sheet-feeder cover 3A being open. When an image forming operation starts, the sheet set on the sheet-feeder cover 3A is fed in the chassis 3 to the image forming unit 5. When the image is formed on the sheet, the sheet with the complete image is ejected out of the chassis 3 and released on the sheet-ejection cover 3B.

Figure 2:
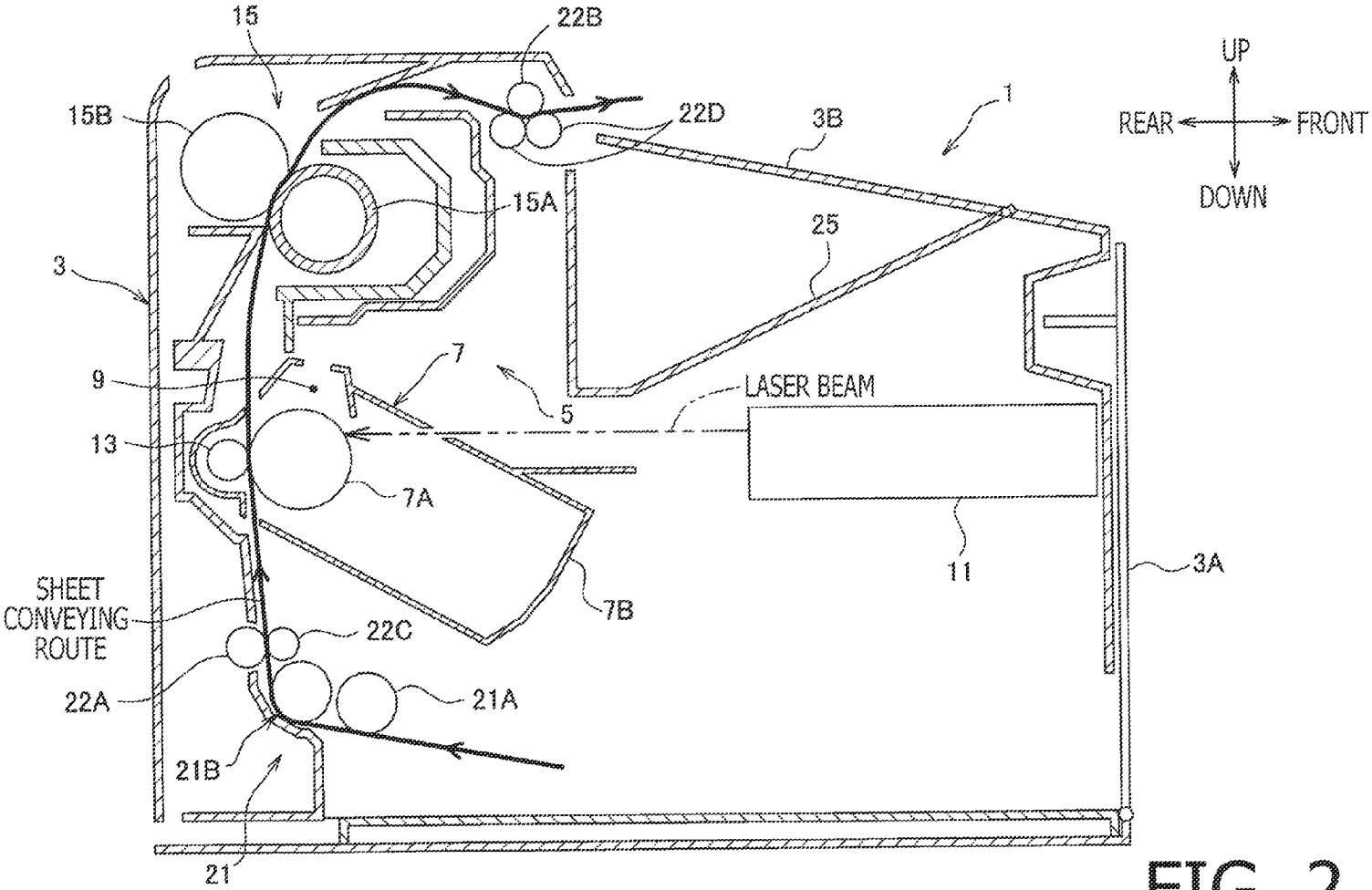
FIG. 2 is a cross-sectional view of the image forming apparatus 1 according to the embodiment of the present invention.

The image forming unit 5 is configured to form the image on the sheet in an electro-photographic method and includes, as shown in FIG. 2, a photosensitive drum 7A, a charger 9, an exposure device 11, a transfer roller 13, and a fixing device 15. The photosensitive drum 7A carries an image formed in a developer agent on a circumference thereof. The charger 9 electrically charges the circumference of the photosensitive drum 7A. The exposure device 11 emits a laser beam to the circumference of the photosensitive drum 7A to form a latent image on an area exposed to the laser beam on the circumference of the photosensitive drum 7A. The transfer roller 13 transfers the image formed in the developer agent and carried on the circumference of the photosensitive drum 7A onto the sheet. The fixing device 15 fixes the image transferred on the sheet.

The photosensitive drum 7A is contained in a casing 7B and is rotatable. The casing 7B further contains the developer agent and a developer device (not shown), which supplies the developer agent to the photosensitive drum 7A. The photosensitive drum 7A, the casing 7B, and the developer device are included in a processing unit 7.

The processing unit 7 is removably supported on a body of the image forming apparatus 1. The body of the image forming apparatus 1 includes frames 17 (see FIG. 3), the chassis 3, and other components, which are not to be removed or detached by a user in regular use. The frames 17 are a pair of panels, which are arranged on lateral (right and left) sides of the image forming unit 5 including the processing unit 7. The frames 17 may be made of, for example, resin.

The operable components, parts, and units which are to be driven by external force, such as the photosensitive drum 7A in the processing unit 7 and the developer device, are driven by driving force generated in a drive source 19 in the image forming apparatus 1. The operable components may be driven by the driving force generated in the drive source 19 and transmitted via drivable parts, such as gears. The drive source 19 is, for example, an electrical motor and generates rotating force. The drive source 19 is attached to one of the paired frames 17 via a second supporting member 23C, which will be described later in detail. In the following description, unless otherwise noted, the one of the paired frames 17, or the frame 17, to which the drive source 19 is attached, denotes the one on the left-hand side. However, the one of the frames 17, or the frame 17, to which the drive source 19 is attached, may be the one on the right-hand side.

The fixing device 15 includes, as shown in FIG. 2, a heat roller 15A and a pressure roller 15B. The heat roller 15A is rotated by the driving force form the drive source 19 and heats the sheet being conveyed. The pressure roller 15B is driven along with the rotation of the heat roller 15A and urges the sheet against the heat roller 15A.

A feeder unit 21 conveys the sheet placed on the sheet-feeder cover 3A to the image forming unit 5. The feeder unit 21 includes a pickup roller 21A, which is rotated by the driving force supplied from the drive source 19, and a separator 21B.

The pickup roller 21A is arranged to be in contact with one of sheets stacked on the sheet-feeder cover 3A, in particular, one of the sheets at one end (e.g., a top end) of the stack along a stacking direction, and is rotated to move the sheet at the one (top) end. The separator 21B separates the one of the sheets at the one end from the stacked other sheets and forwards the separated sheet toward the image forming unit 5.

A conveyer roller 22A conveys the sheet passed from the separator 21B toward the photosensitive drum 7A and the transfer roller 13. An ejection roller 22B forwards the sheet passed from the fixing device 15 toward the sheet-ejection cover 3B to eject.

A pressure roller 22C urges the sheet against the conveyer roller 22A and is rotated along with the sheet being conveyed. A pair of pressure rollers 22D urges the sheet against the ejection roller 22B to remove curl from the sheet and is rotated along with the sheet being ejected.

2. Transmission of Driving Force from the Drive Source to the Processing Unit and the Feeder Unit 2.1 Transmission of Driving Force to the Processing Unit In positions opposite from the processing unit 7 across the one of the paired frames 17, to which the drive source 19 is attached, as shown in FIG. 3, a first pulley 23 and a second pulley 25 are arranged. Rotation axes of the first pulley 23 and the second pulley 25 extend in parallel with each other. In a transmission path for the driving force from the drive source 19 to the operable components via the drivable parts, the first pulley 23 is closer to the drive source 19, and the second pulley 25 is closer to the drivable parts. In other words, the first pulley 23 is arranged on a side of the drive source 19, and the second pulley 25 is arranged on a side of the drivable parts. In the following description, the first pulley 23 and the second pulley 25 may also be referred to as a driving pulley 23 and a driven pulley 25 respectively.

An endless belt 27 is strained around the driving pulley 23 and the driven pulley 25, and the driving force is transmitted from the driving pulley 23 on the drive-source side to the driven pulley 25 on the drivable-parts side via the belt 27. The belt 27 is a toothed belt with teeth, which mesh with teeth formed on outer circumferences of the driving pulley 23 and the driven pulley 25.

In the transmission path, in a position between the drive source 19 and the driving pulley 23, a reducer 29 to reduce the driving force is provided. The reducer 29 is a gear system including a larger gear 29A and a smaller gear 29B. The larger gear 29A is arranged in a coaxial position with the driving pulley 23 and rotates integrally with the driving pulley 23. The smaller gear 29B is arranged to mesh with the larger gear 29A and is rotated by the driving force supplied from the drive source 19.

As shown in FIG. 4, the driving pulley 23 and the larger gear 29A are integrally formed in resin to configure a first rotating body 23A. Therefore, the larger gear 29A is a rotating body on a driving side, which rotates along with the driving pulley 23 being rotated by the driving force from the drive source 19, while a second rotating body 25A is a rotating body on a driven side, which is driven by the driving force input through the belt 27.

The driving pulley 23 is arranged on a side opposite from the frame 17 across the larger gear 29A. A shaft 23B, which supports the first rotating body 23A (or the driving pulley 23) rotatably, is fixed to a second supporting member 23C. The second supporting member 23C is a thin piece of metal, such as SPCC (cold-rolled steel plate).

On the second supporting member 23C, as shown in FIG. 5, the drive source 19 is attached. The drive source 19 is fixed to the second supporting member 23C by a fastening means such as a screw 19A. The shaft 23B is fixed to the second supporting member 23C by deforming a part of the second supporting member 23 plastically C and being swaged thereto.

The second supporting member 23C is arranged on the side of the processing unit 7 with respect to the frame 17 and is fixed to the frame 17 by a fastening means such as a screw (not shown). The shaft 23B is fixed to the second supporting member 23C by swaging and penetrates the frame 17 to protrude from the frame 17 to reach the side of the first rotating body 23A.

The driven pulley 25 is an input rotating body on the driven side, which is rotated by the driving force input through the belt 27 (see FIG. 4). An output gear 31 is arranged in a coaxial position with respect to the driven pulley 25 and rotates along with the driven pulley 25 to output the driving force. The output gear 31 in the present embodiment is a helical gear, of which teeth are formed to incline with respect to a rotation axis.

The driven pulley 25 and the output gear 31 are formed in resin integrally to configure the second rotating body 25A. The second rotating body 25A is an input rotating body subjected to the driving force, which is input from the drive source 19 via the belt 27, and is rotatable by the driving force.

The second rotating body 25A includes, as shown in FIG. 6, a cylinder part 25B, a hub 25C, which is formed to close one axial end of the cylinder part 25B, and a tubular bearing 25E, in which a shaft 25D is inserted. The second rotating body 25A is rotatably supported in the bearing 25E by the shaft 25D.

The driven pulley 25 and the output gear 31 are formed in resin on an outer circumference of the cylinder part 25B integrally with the cylinder part 25B, the hub 25C, and the bearing 25E. The cylinder part 25B is formed to be open-ended at the other axial end opposite from the hub 25C. An inner circumference 25F of the cylinder part 25B is formed in a plain surface traced in parallel with an axis of the cylinder part 25B. Accordingly, cylindrically-shaped hollow space 25G is formed inside the cylinder part 25B.

While the second rotating body 25A is integrally formed with the bearing 25E, it may be viewed that the second rotating body 25A is in a shape of a tube cake. Therefore, it may be viewed that the space 25G formed inside the cylinder part 25B is in a shape of the tube cake.

The shaft 25D is fixed to a metal-made first supporting member 33, which is a thin piece of metal such as SPCC, at one axial end thereof. As shown in FIG. 8, the first supporting member 33 is arranged in a position opposite from the frame 17 across the second rotating body 25A to cover at least a part of the second rotating body 25A laterally.

The shaft 25D is in a cantilever structure held solely at the one axial end on the side of the first supporting member 33. In other words, the first supporting member 33 supports the second rotating body 25A via the shaft 25D. Meanwhile, as shown in FIG. 6, the driven pulley 25 is arranged in a position closer to the first supporting member 33 with respect to the output gear 31 in the cylinder part 25B.

The first supporting member 33 is fixed to the frame 17 by a fastening means, such as screws (unsigned), on the opposite side from the processing unit 7 across the frame 17. The shaft 25D is fixed to the first supporting member 33 by deforming a part of the second supporting member 33 plastically and by being swaged thereto. The belt 27 is strained by a predetermined intensity of tensile force applied by a tensile force applier 27A (see FIG. 3), which utilizes resiliency of for example, a spring.

In the space 25G in the second rotating body 25A, as shown in FIG. 7, a joint 35 is housed. The joint 35 is rotated by the driving force input to the second rotating body 25A. The joint 35 is arranged in a coaxial position with respect to the second rotating body 25A and is movable in the axial direction of the second rotating body 25A.

As the joint 35 moves in the axial direction, transmission and disconnection of the driving force from the second rotating body 25A to the processing unit 7 is switched. In the following description, the space 25G may be referred to as accommodating space 25G. A structure to move the joint 35 in the axial direction will be described below in detail.

The joint 35 is a movable member including a tubular movable part 35A and an engaging part 35B. The engaging part 35B is engageable with an engageable part 7C in the processing unit 7, which transmits the driving force transmitted from the joint 35 to the operable components such as the photosensitive drum 7A.

The movable part 35A is movable in the axial direction while being engaged with the bearing 25E. The engaging part 35B is formed integrally with the movable part 35A on one of axial ends of the movable part 35A. As shown in FIG. 6, when the joint 35 is in a position closer to the processing unit 7 and the engaging part 35B engages with the engageable part 7C, the transmission path to convey the driving force from the second rotating body 25A, i.e., the driven pulley 25, to the processing unit 7 is established.

As shown in FIG. 7, on the other hand, when the joint 35 is shifted to a separated position farther from the processing unit 7 to be closer to the first supporting member 33, the engaging part 35B is disengaged from the engageable part 7C; therefore, the transmission path to convey the driving force from the second rotating body 25A, i.e., the driven pulley 25, to the processing unit 7 is disconnected.

When the joint 35 is separated from the processing unit 7, the engaging part 35B is entirely withdrawn from an inner plane 17A of the frame 17, which is a plane of the frame 17 on the side of processing unit 7, to the side of the second rotating body 25A. In this regard, the joint 35 is partly housed in the accommodating space 25G into ranges coincident with the driven pulley 25 and with the output gear 31.

In the present embodiment, the joint 35 being in the ranges in the accommodating space 25G coincident with the driven pulley 25 and the output gear 31 denotes a condition of the joint 35, of which other one of axial ends, i.e., an axial end opposite from the engaging part 35B, reaches a range B corresponding to the driven pulley 25 in the accommodating space 25G across a range A corresponding to the output gear 31 (see FIG. 7).

2.2 Transmission of Driving Force to the Feeder Unit

The operable components stored in the processing unit 7, such as the photosensitive drum 7A, are driven by the driving force transmitted from the second rotating body 25A via the joint 35. Meanwhile, sheet-conveying components not contained in the processing unit 7, such as the feeder unit 21, the fixing device 15, and conveying rollers are, as shown in FIG. 3, rotated by the driving force transmitted via transmission gears 37A-37C, which are meshed with the output gear 31.

The transmission gear 37A conveys the driving force to the rollers in the feeder unit 21, including the pickup roller 21 and the conveyer roller 22A. The transmission gear 37B conveys the driving force to the transfer roller 13. The transmission gear 37C conveys the driving force to the heat roller 15A and the ejection roller 22B.

Rotation shafts 38 of the transmission gears 37A-37C and gears meshed with the transmission gears 37A-37C are rotatably supported by the frame 17 and the first supporting member 33. In FIG. 9, solely representing one of the shafts 38 is shown. As shown in FIG. 9, the first supporting member 33 has a first bearing 38A, which is formed to be in contact with one of axial ends of the shaft 38 to rotatably support the shaft 38. Similarly, the frame 17 has a second bearing 38B, which is formed to be in contact with the other of axial ends of the shaft 38 to rotatably support the shaft 38.

The first bearings 38A are formed in the first supporting member 33 by burr-formation and plastically deforming a part of the first supporting member 33 into cylindrical shapes. The second bearings 38B are formed in the frame 17 by shaping cylindrical parts integrally with the frame 17.

2.3 Encoder

On the second supporting member 23C, as shown in FIG. 5, an encoder 51 to detect a rotating quantity of the drive source 19 is arranged. The encoder 51 includes a rotor 51A, which rotates mechanically in conjunction with the drive source 19, and a detecting unit 51D. The detecting unit 51D includes a photo-sensor 51B and circuit board 51C.

The rotor 51A is formed in a shape of a disk and has a plurality of through holes (not shown) perforated, which extend linearly along radial directions. The through holes are formed in evenly spaced-apart positions from one another along a circumference of the disk. The photo-sensor 51B includes a light-emitter and a light-receiver, which are not shown. On the circuit board 51C, circuits including a driving circuit to drive the photo-sensor 51B are arranged.

The detecting unit 51D detects a rotation angle of the drive source 19 with reference to a count of receiving the light in the light-receiver. The detecting unit 51D, more specifically, the photo-sensor 51B and the circuit board 51C are held by a holder 53, which is fixed to the second supporting member 23C.

The holder 53 is placed in a correct position with respect to the frame 17 and the first supporting member 33 by a positioning part 17C formed in the frame 17. The positioning part 17C is formed to be in contact with the holder 53 and the second supporting member 23C to restrict the holder 53 and the second supporting member 23C from moving.

The positioning part 17C is a protrusion, which protrudes from the frame 17 toward the side of the processing unit 7. Meanwhile, in the holder 53 and the second supporting member 23C, through holes, in which positioning part 17C is inserted, are formed.

Therefore, when the positioning part 7C is inserted in the through-holes of the holder 53 and the second supporting member 23C to penetrate, the holder 53 and the second supporting member 23C are restricted from moving and are fixed to the correct positions with respect to the frame 17.

In the present embodiment, mainly in order to fix the drive source 19 to the second supporting member 23C securely in position, the second supporting member 23C is formed to have a thickness dimension T2, which is greater than thickness dimension T1 (see FIG. 9) of the first supporting member 33.

3. Driving System for the Joint 3.1 Configuration of Joint Driving System and Movements with the Driving System A joint driving system 40 will be described herein below. The joint driving system 40 moves the joint 35 between an engaged position (FIG. 6), in which the engaging part 35B is engaged with the engageable part 7C, and a disengaged position (FIG. 7), in which the engaging part 35B is disengaged from the engageable part 7C to be separated from the processing unit 7.

Basic configuration and behaviors of the joint driving system 40 may be similar to those disclosed in, for example, Japanese Patent Provisional Publication No. 2008-304704.

As shown in FIG. 10, the joint driving system 40 includes the joint 35, a rotation cam 41, a translation cam 43, a restricting cam 45, a linker 47, and a spring 49.

The rotation cam 41 is, as shown in FIG. 11, coupled to the top cover 3C through the linker 47. The rotation cam 41 is rotatable about the shaft 25D with respect to the frame 17 in conjunction with the movement of the top cover 3C.

The top cover 3C is swingably attached to the chassis 3 and is swingable between an open position, in which an opening (not shown) formed in the chassis 3 is exposed, and a closed position, in which the opening is closed. The opening is formed in an upper position of the chassis 3 and is exposed when, for example, the processing unit 7 is exchanged. With the opening being exposed, the processing unit 7 can be removed from and installed in the image forming apparatus 1 through the opening.

The rotation cam 41 includes, as shown in FIG. 10, a first slider edge 41A, which is formed to protrude in a helix curving around a rotation axis of the rotation cam 41. The translation cam 43 includes a slider part 43B and an engageable part 43C and is movable to shift positions thereof in an axial direction according to a rotation angle of the rotation cam 41.

The slider part 43B is formed to have a slidable edge 43A, which slidably contacts the first slider edge 41A of the rotation cam 41. The engageable part 43C is engageable with a flange 35C formed in the joint 35.

The slider part 43B is, as shown in FIGS. 12 and 13, movable to shift positions thereof in an axial direction L1 along with the joint 35 with the slider part 43B sliding with respect to the first slider edge 41A as the rotation cam 41 rotates due to a screwing principle (a wedging effect).

The restricting cam 45 includes, as shown in FIG. 12, a second slider edge 45A, which slidably contacts an edge of the slider part 43B in the translation cam 43 at a side opposite from the first slider edge 41A across the slider part 43B. It is to be noted that each of the first slider edge 41A, the second slider edge 45A, and the slidable edge 43A includes two pieces, which are arranged in rotationally symmetric positions with respect to the rotation axis of the rotation cam 41.

As shown in FIGS. 12 and 13, the second slider edge 45A of the restricting cam 45 is formed to incline in a reversed angle with respect to the helical inclination of the first slider edge 41A. Therefore, as the rotation cam 41 rotates, the translation cam 43 shifts positions thereof in the axial direction L1 along with the rotation of the rotation cam 41 and therefore moves the joint 35 in the axial direction L1.

For example, when the rotation cam 41 rotates to bring a corner point P1 of the first slider edge 41A and a corner point P2 of the second slider edge 45A relatively closer to each other, as shown in FIG. 13, the slidable edge 43A and the first slider edge 41A contact each other, and the slider part 43B of the translation cam 43 is urged against the second slider edge 45A.

In this regard, while the restricting cam 45 including the second slider edge 45A is not movable, compression force F3 to move the slider part 43B in a direction to compress the spring 49 is generated in a contact surface between the slider part 43B and the first slider edge 41A and in a contact surface between the slider part 43B and the second slider edge 45A.

Thus, the translation cam 43 moves in the direction of the compression force F3, and the joint 35 is moved from the engaged position to the disengaged position. In this regard, while force F1 rotates the rotation cam 41, and force F2 is a component in the force F1 in an orientation orthogonal to the first slider edge 41A and the slidable edge 43A, the compression force F3 is a component in the force F2 in an orientation in parallel with the axial direction L1.

On the other hand, when the rotation cam 41 rotates in a direction to separate the corner point P1 of the first slider edge 41A and the corner point P2 of the second slider edge 45A apart from each other, as shown in FIG. 12, the force F1 dissolves, and the compression force F3 dissolves. Accordingly, the spring 49 restores to the expanded condition. Thus, the translation cam 43 is pressed by the spring 49 to move in a direction opposite from the compression force F3, and the joint 35 is shifted from the disengaged position to the engaged position.

Meanwhile, as shown in FIG. 11, the linker 47 is attached to the rotation cam 41 at one end thereof rotatably and to the top cover 3C at the other end thereof rotatably. With the linker 47, the opening and closing motions of the top cover 3C is converted into the rotation of the rotation cam 41. Therefore, the joint 35 is moved in the axial direction L1 in conjunction with the swing motions of the top cover 3C.

In the present embodiment, when the top cover 3C is in the open position, as indicated in double-dotted chain lines shown in FIG. 11, the joint 35 is placed in the disengaged position. When the top cover 3C is in the closed position, as indicated in solid lines FIG. 11, the joint 35 is placed in the engaged position.

Further, on the one end of the linker 47, as shown in FIG. 10, a pin-like boss 47A is formed. Meanwhile, the rotation cam 41 is formed to have an arm 41B, which extends radially outwardly beyond the restricting cam 45. The arm 41B is formed to have a connection hole 41C at a tip end thereof, and with the boss 47A rotatably inserted in the connection hole 41C, the linker 47 and the rotation cam 41 are rotatably coupled to each other.

3.2 Linker and the Joint Driving System

As shown in FIG. 3, the linker 47 partly coincides with the belt 27 along a direction in parallel with the rotation axis of the driving pulley 23. Therefore, when the linker 47 and the belt 27 are viewed along the direction in parallel with the rotation axis of the driving pulley 23, the linker 47 extends in a direction to intersect a strained part 27B of the belt 27. The strained part 27B denotes a part of the belt 27, which extends linearly along a direction of a tangent line between the driving pulley 23 and the driven pulley 25.

As shown in FIGS. 14A-14B, the linker 47 has a first part 47B, which coincides with the belt 27 along the direction in parallel with the rotation axis of the driving pulley 23, and a second part 47C, which is displaced from the first part 47B with respect to the direction in parallel with the rotation axis of the driving pulley 23. The first part 47B and the second part 47C of the linker 47 may be formed integrally in, for example, resin.

At least the first part 47B of the linker 47 is arranged in a position between the frame 17 and the belt 27. In the present embodiment, the second part 47C is arranged in a position displaced from the first part toward a side opposite from the frame, i.e., closer to the belt 27 with respect to the first part 47B.

The second part 47C of the linker 47 is in the displaced position to be closer to the belt 57 with respect to the first part 47B at least in a reason that the second part 47C should avoid interference with the transmission gear 37D, which transmits the driving force to the ejection roller 22. Therefore, if the linker 47 is not interfered with by the transmission gear 37 or any other components when in motion, the second part 47C may not necessarily be arranged in the displaced position with respect to the first part 47B, but the linker 47 may be entirely arranged in a position closer to the frame 17 than the belt 27.

The frame 17 is formed to have a stopper 17B (see FIGS. 15A, 15B), which holds the linker 47, when the top cover 3C is opened, to maintain the opened posture of the top cover 3C. The stopper 17B is resiliently deformable to be engaged with a hook protrusion 47D formed in the linker 47. When the hook protrusion 47D is disengaged from the stopper 17B, the stopper 17B may be resiliently deformed to be moved apart from the hook protrusion 47D.

The first supporting member 33 is formed to have a bulge 33A (FIG. 16), which protrudes toward the belt 27, on the side of the belt 27. The bulge 33A is formed to be closer to the belt 27 compared to the other area of the first supporting member 33 which does not have the bulge 33A. The bulge 33A serves to prevent the belt 27 from being displaced toward the first supporting member 33 or being deviated from the driving pulley 23 or the driven pulley 25.

In the present embodiment, as shown in FIG. 8, the bulge 33A is formed in a position in one of the paired strained parts 27B closer to the tensile force applier 27A. However, the bulge 33A may be formed on both of the paired strained parts 27 or on an entire range covering the strained parts 27B.

In the present embodiment, the linker 47 is arranged in the position closer to the frame 17 with respect to the belt 27. Therefore, along a direction from the driving pulley 23 toward the driven pulley 25, the linker 47 and the larger gear 29A being the rotating body on the driving side are in mutually coincident positions, and the linker 47 and the output gear 31 are in mutually coincident positions.

4. Features of the Image Forming Apparatus

According to the present embodiment, the gears 37A-37C and the drive source 19 are supported by the first supporting member 33 and the second supporting member 23C respectively, which are made in metal and superior in rigidity than resin. Therefore, the relative positions of the gears 37A-37C and the drive source 19 can be correctly maintained.

Further, according to the present embodiment, the driving force from the drive source 19 is transmitted to the gears 37A-37C via the belt 27. Therefore, even if the positional relation between the gears 37A-37C and the drive source 19 changes, the belt 27 may deform and absorb the relative displacement.

Thus, while the manufacturing cost can be lowered by employing the resin-made frames 17 as a main part of the frame assembly, the positions of the gears 37A-37C being the drivable parts can be correctly maintained.

Further, according to the present embodiment, the accommodating space 25G to accommodate at least a part of the joint 35, when the joint 35 is separated from the processing unit 7, is formed in the second rotating body 25A. Thus, the joint 35 is at least partially accommodated in the area, which is occupied by the second rotating body 25A. Therefore, it is not necessary to reserve extra space for the joint 35 to be accommodated. In other words, the image forming apparatus 1 may be downsized.

According to the present embodiment, the driven pulley 25 being the input rotating body and the output gear 31 being the output rotating body are arranged on the outer periphery of the cylinder part 25B. In the meantime, the accommodating space 25G is formed inside the cylinder part 25B and provides accommodation to the at least part of the joint 35, when the joint 35 is separated from the processing unit 7, so that the joint 35 is drawn in the ranges corresponding to the driven pulley 25 and the output gear 31.

Therefore, a large part of the space occupied by the second rotating body 25A can be utilized to accommodate the at least a part of the joint 35, and the image forming apparatus 1 can be downsized even more effectively. In the above embodiment, it is to be noted that the tubular cylinder part 25B may be formed to have a smooth inner circumferential surface without any recognizable protrusion or dent or may be formed to have protrusion and/or dent on the inner circumferential surface.

According to the present embodiment, the reducer 29 to reduce the driving force from the drive source 19 and transmit the reduced driving force to the driving pulley 23 is provided. With the reducer 29, a moving velocity of the belt 27 can be reduced; therefore, it can be prevented that the belt 27 is abraded or damaged by a faster moving velocity in a shorter time period.

When the driving force is transmitted by the belt 27, it may be necessary that predetermined intensity of straining force to strain the belt 27 is maintained. Therefore, the driven pulley 25 may be subject to a large amount of load due to the straining force. However, according to the present embodiment, the first supporting member 33 to support the second rotating body 25A at the one axial end of the second rotating body 25A. Further, the driven pulley 25 is arranged in the position closer to the first supporting member 33 with respect to the output gear 31.

Therefore, with the driven pulley 25 arranged in the position closer to the first supporting member 33, a defect which may be caused by the driven pulley 25 affected by the straining force, such as being tilted, may be avoided.

According to the present embodiment, the accommodating space 25G is in a tubular shape formed along the axial direction of the driven pulley 25, and the inner circumference 25F defining the accommodating space 25G provides a plain surface, which traces straight along the direction in parallel with the axial direction.

In other words, there is no specific obstacle, which interferes with the joint 35 when the joint 35 shifts positions thereof. Therefore, the joint 35 can smoothly move in the accommodating space 25G.

Further, if the driven pulley 25 and the output gear 31 are formed integrally in injection molding, and if the inner circumference defining the accommodating space 25 provides the plain cylindrical surface, of which outline is traced straight along the axial direction, the molds can be easily removed when the driven pulley 25 and the output gear 31 are unmolded. Thus, productivity of the second rotating body 25A can be improved.

When the driven pulley 25 and the output gear 31 are integrally formed in injection molding, it may be necessary that the inner circumference 25F is inclined at a predetermined angle as a draft angle. Therefore, the plain cylindrical surface of the inner circumference 25F traced straight along the axial direction should include inclination of the draft angle.

According to the present embodiment, the linker 47 and a part of the belt 27 are in coincident positions along the direction in parallel with the rotation axis of the driving pulley 23.

If the linker 47 and the belt 27 are not in coincident positions along the direction of the rotation axis, the linker 47 should be arranged in an area separated from the area occupied by the belt 47. In other words, it is necessary to reserve a separated area to be occupied the linker 47. Accordingly, a size of the image forming apparatus 1 may be increased.

On the contrary, according to the present embodiment, the linker 47 and the belt 27 are in partially coincident positions along the direction in parallel with the rotation axis. Therefore, the area in which the belt 27 is arranged is effectively used, and the image forming apparatus can be downsized.

More Examples

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the first supporting member 33 may not necessarily be placed in the opposite position from the image forming unit 5 across the frame 17, or the second supporting member 23C may not necessarily be placed on the same side as the image forming unit 5 with respect to the frame 17. That is, the first supporting member 33 may be placed on the same side as the image forming unit 5 with respect to the frame 17 while the second supporting member 23C may be placed on the opposite side from the image forming unit 5 across the frame 17. For another example, both the first supporting member 33 and the second supporting member 23 may be placed on the same side as the image forming unit 5 with respect to the frame or on the opposite side from the image forming unit 5 across the frame 17.

For another example, the thickness dimension T2 of the second supporting member 23C may not necessarily be greater than the thickness dimension T1 of the first supporting member 33 but may be smaller than, or equal to, the thickness T1 of the first supporting member 33.

For another example, the positions of the holder 53 and the second supporting member 23C with respect to the frame 17 may not necessarily be defined by the same positioning part 17C but may be defined with reference to different positioning parts respectively.

For another example, the bearings 38A, 38B to contact and support the shafts 38, which are the shafts of the gears including the gears 37A-37C, may not necessarily be formed in the first supporting member 33 and the frame 17 respectively. For example, the bearings 38A, 38B may be omitted or may be formed in other components and attached to the first supporting member 33 and the frame 17 respectively.

For another example, the accommodating space 25G to accommodate the joint 35 may not necessarily be formed in the second rotating body 25A but may be omitted.

For another example, the joint 35 may not necessarily be accommodated in the accommodating space 25G in the ranges corresponding to the driven pulley 25 and the output gear 31 but may be accommodated in one of the ranges corresponding to the driven pulley 25 and the output gear 31.

For another example, the joint 35 may not necessarily be drawn into the accommodating space 25G to reach the range corresponding to the driven pulley 25 across the range corresponding to the output gear 31. For example, when the driven pulley 25 is in a position closer to the frame 17 with respect to the output unit 31, the joint 35 may be drawn into the range corresponding to the output gear 31 across the area corresponding to the driven pulley 25.

For another example, the driving force from the drive source 19 may not necessarily be reduced to be transmitted to the driving pulley 23 but may be directly transmitted to the driven pulley 23 without being reduced.

For another example, in the above embodiment, the shaft 25D to support the second rotating body 25A is supported at one of the axial ends by the first supporting member 33 while the driven pulley 25 is arranged on the axial end side being supported by the first supporting member 33. However, the shaft 25D may be supported at the both axial ends. For another example, the shaft 25D may be supported by the output gear 31.

For another example, the inner circumference 25F defining the accommodating space 25G may not necessarily provide a plain surface, which traces straight along the axial direction in parallel with the axial direction. For example, the inner circumference 25F may be in a tapered shape or a stepped shape, in which an inner diameter of the second rotating body 25A is greater at a part closer to the output gear 31 and an inner diameter of the second rotating body 25A is smaller at a part closer to the driven pulley 25.

For another example, the driving force may not necessarily be transmitted from the output gear 31 to the fixing device 15 or to the feeder unit 21.

For another example, the first part 47B and the second part 47C of the linker 47 may not necessarily be bent at the mutually coupled position, but the linker 47 may be formed linearly, or the linker 47 may be bent at a different position from the mutually coupled position between the first part 47B and the second part 47C.

For another example, the image forming apparatus 1 may not necessarily be the image forming apparatus of the monochrome electro-photographic type but may be, for example, an image forming apparatus of direct tandem type.

What is claimed is:

1. An image forming apparatus, comprising:

an image forming unit configured to form an image on a sheet;

a frame made of resin and configured to support the image forming unit;

a drive source configured to generate driving force, the drive source being on a one-end side of a transmission path for the driving force;

a gear arranged on the other-end side of the transmission path and configured to be rotated by the driving force generated in the drive source, one of axial ends of a shaft of the gear being supported by the frame;

a first supporting member made of metal, fixed to the frame, and configured to support the other of axial ends of the shaft of the gear thereon;

a second supporting member made of metal, fixed to the frame, and configured to support the drive source thereon;

an endless belt configured to transmit the driving force from the one-end side to the other-end side;

a first pulley configured to transmit the driving force generated in the drive source to the endless belt, the first pulley being supported by the second supporting member;

a second pulley arranged to have the endless belt strained there-around and configured to transmit the driving force transmitted from the first pulley via the endless belt toward the other-end side, the second pulley being supported by the first supporting member;

a processing unit comprising operable components, which are configured to be driven by the driving force transmitted from the second pulley via the gear, the processing unit being detachably attached to the frame; and a joint configured to switch transmission and disconnection of the driving force from the second pulley to the processing unit by moving along an axial direction of the second pulley between an engaged position, in which the joint is engaged with the processing unit, and a separated position, in which the joint is separated from the processing unit.

2. The image forming apparatus according to claim 1, wherein each of the first supporting member and the frame comprises a bearing, which is configured to contact the shaft of the gear.

3. The image forming apparatus according to claim 1, further comprising:

a detecting unit configured to detect a rotation angle of the drive source; and a holder configured to hold the detecting unit, the holder being fixed to the second supporting member.

4. The image forming apparatus according to claim 3, wherein the frame comprises a positioning part, which is configured to contact the holder and the second supporting member and to restrict the holder and the second supporting member from moving.

5. The image forming apparatus according to claim 1, wherein, in a position between the drive source and the first pulley in the transmission path, a reducer configured to reduce the driving force from the drive source and transmit the reduced driving force to the first pulley, is provided.

6. The image forming apparatus according to claim 1, wherein a dimension of thickness of the second supporting member is greater than a dimension of thickness of the first supporting member.

7. The image forming apparatus according to claim 1, wherein the second supporting member is fixed to a same side of the frame as the image forming unit; and wherein the first supporting member is fixed to an opposite side of the frame from the image forming unit across the frame.

8. An image forming apparatus, comprising:

an image forming unit configured to form an image on a sheet;

a frame made of resin and configured to support the image forming unit;

a drive source configured to generate driving force, the drive source being on a one-end side of a transmission path for the driving force;

a gear arranged on the other-end side of the transmission path and configured to be rotated by the driving force generated in the drive source, one of axial ends of a shaft of the gear being supported by the frame;

a first supporting member made of metal, fixed to the frame, and configured to support the other of axial ends of the shaft of the gear thereon;

a second supporting member made of metal, fixed to the frame, and configured to support the drive source thereon;

an endless belt configured to transmit the driving force from the one-end side to the other-end side;

a first pulley configured to transmit the driving force generated in the drive source to the endless belt, the first pulley being supported by the second supporting member;

a second pulley arranged to have the endless belt strained there-around and configured to transmit the driving force transmitted from the first pulley via the endless belt toward the other-end side, the second pulley being supported by the first supporting member;

a detecting unit configured to detect a rotation angle of the drive source; and a holder configured to hold the detecting unit, the holder being fixed to the second supporting member.

9. The image forming apparatus according to claim 8, wherein each of the first supporting member and the frame comprises a bearing, which is configured to contact the shaft of the gear.

10. The image forming apparatus according to claim 8, wherein the frame comprises a positioning part, which is configured to contact the holder and the second supporting member and to restrict the holder and the second supporting member from moving.

11. The image forming apparatus according to claim 8, wherein, in a position between the drive source and the first pulley in the transmission path, a reducer configured to reduce the driving force from the drive source and transmit the reduced driving force to the first pulley, is provided.

12. The image forming apparatus according to claim 8, wherein a dimension of thickness of the second supporting member is greater than a dimension of thickness of the first supporting member.

13. The image forming apparatus according to claim 8, wherein the second supporting member is fixed to a same side of the frame as the image forming unit; and wherein the first supporting member is fixed to an opposite side of the frame from the image forming unit across the frame.

* * * * *